United States Patent [19]

Slocomb, Jr.

[11] 4,110,942

[45] Sep. 5, 1978

[54] WINDOW FRAME MANUFACTURE

[76] Inventor: Leon F. Slocomb, Jr., 2641 W. Robino Dr., Sherwood Park, Wilmington, Del. 19808

[21] Appl. No.: 794,357

[22] Filed: May 6, 1977

[51] Int. Cl.[2] ..... E04C 2/10

[52] U.S. Cl. ..... 52/100; 52/122; 52/308; 52/397; 52/730

[58] Field of Search ..... 52/732, 737, 627, 731, 52/720, 623, 100, 403, 400, 399, 397, 398, 202, 203, 730, 616, 304, 122, 308

[56] References Cited

U.S. PATENT DOCUMENTS

| | | | |
|---|---|---|---|
| 1,608,672 | 11/1926 | Rappaport | 52/731 X |
| 2,024,192 | 12/1935 | Verhagen | 52/400 X |
| 2,575,655 | 11/1951 | Clerk | 52/403 |
| 2,979,788 | 4/1961 | Richardson | 52/400 X |
| 3,012,642 | 12/1961 | Emmerich | 52/399 X |
| 3,158,909 | 12/1964 | Downs | 52/403 X |
| 4,006,569 | 2/1977 | Kain | 52/400 X |

FOREIGN PATENT DOCUMENTS

| | | | |
|---|---|---|---|
| 885,224 | 11/1971 | Canada | 52/398 |
| 2,449,726 | 4/1976 | Fed. Rep. of Germany | 52/616 |

*Primary Examiner*—James L. Ridgill, Jr.
*Attorney, Agent, or Firm*—Connolly and Hutz

[57] ABSTRACT

Different sections of frames for windows and the like are made from identical plastic resin tubular bodies which are extruded with a plurality of appendages and shapes each of which serves a specific function in accordance with the intended use thereof, and with the appendages inapplicable to that use being removed therefrom.

6 Claims, 6 Drawing Figures

WINDOW FRAME MANUFACTURE

BACKGROUND OF THE INVENTION

Window frames are frequently formed with various sections or sides of the frames having distinctive structure. For example with a double sash window the bottom section of the lower sash includes an outwardly extending appendage functioning as a hand lift so that the lower sash can be raised. The top section, however, includes a downwardly turned appendage which functions as a locking lip in cooperation with an upwardly turned appendage at the lower section of the upper sash. This upwardly turned appendage thus functions as a top or locking rail. Such specialized appendages, however, are not required and not provided for the sides of the sashes.

Such frames having the specialized appendages are generally formed for the frame in separate sections in individual operations. Thus, for example, where extrusion procedures are used, four separate extrusion dies would be required and four separate extrusion operations performed.

SUMMARY OF THE INVENTION

An object of this invention is to provide a basic frame structure which includes a plurality of appendages whereupon by selective removal of the appendage the same basic structure may be utilized for different frame sections.

A further object of this invention is to provide such a structure having a sufficient number of appendages that all sections of a frame may be thus formed from the same extruded structure.

A still further object of this invention is to provide a method of making such frame structure.

Another object of this invention is to reduce considerable extrusion down time and to minimize scrap generation by minimizing the die changes.

In accordance with this invention a tubular frame is formed having a plurality of appendages each intended to serve a specialized function in accordance with the desired end use thereof. By selective removal of the appendages the same basic frame may thus be used to function as different frame sections with only one extrusion die and extrusion operation thereby required.

In the preferred form of this invention three such appendages are provided to function as a hand lift, locking lip, and locking rail, respectively. Removal of all appendages also permits the structure to function as the side sections of the frame.

THE DRAWINGS

DETAILED DESCRIPTION

Although the present invention is primarily concerned with window frame structure it would be helpful in understanding the invention if one particular prior art practice were discussed.

Figure 1:
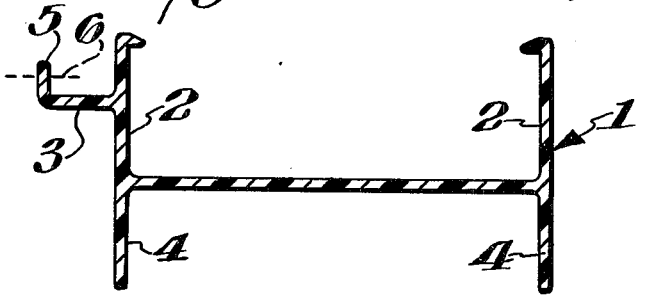
Fig. 1 (Prior Art)
FIG. 1 is a cross-sectional view in elevation of a portion of a prior art frame section.

FIG. 1 illustrates such a prior art arrangement which is intended to accommodate a screen frame and the removal thereof. As illustrated therein frame section 1 includes side wall 2, 2 and 4, 4 for receiving, for example, glass window inserts. In the illustrated embodiment an L-shaped appendage having a horizontal leg 3 and a vertical leg 5 is provided for mounting a screen adjacent to the window inserts. The L-shaped extension acts as a track for the screen. In order to permit installation and removal of the screen, a portion of the track, that is one side of vertical leg 5, must be shorter than the opposite of the track. In this prior art practice the leg 5 is thereby cut in a suitable manner as indicated by the cutting line 6. Since leg 5, however, is not supported where the cut takes place, the resultant cut generally is not flat but rather is frequently convex.

The present invention distinguishes over the prior practice indicated with respect to FIG. 1 in a number of ways. With the present invention, for example, appendages are provided not for the purpose of holding a screen but rather to function in a specific manner in accordance with the intended location or section of the finished frame. Moreover, removal of the appendages results in a cut which is flush or concave.

Figure 2:
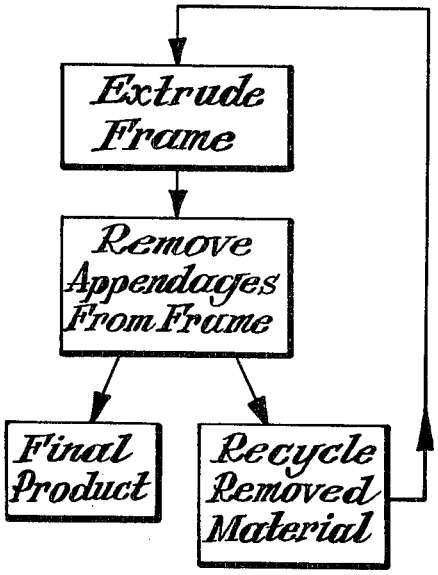
FIG. 2 is a block diagram indicating the steps utilized in forming the frame sections in accordance with this invention.
Figure 3:
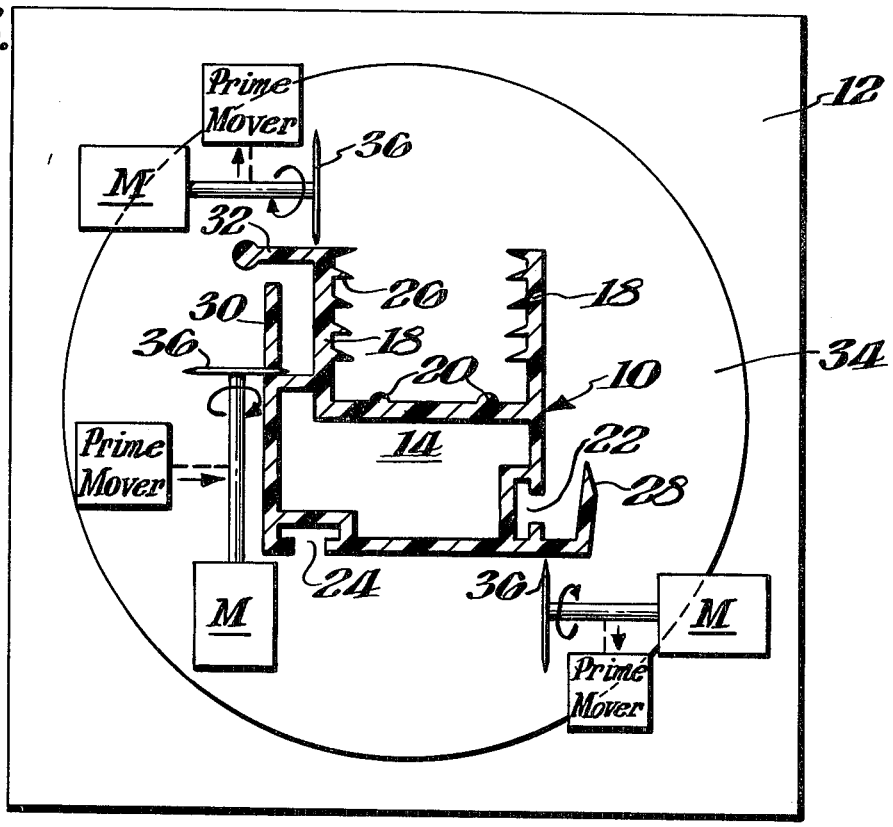
FIG. 3 is a cross-sectional view in elevation illustrating a frame section made in accordance with this invention and indicating the selective cutting operations.

FIGS. 2–3 illustrate the general steps taken in practicing the invention. As indicated therein a basic frame structure 10 is extruded from a conventional extruder 12. Frame 10 has a hollow interior 14 and for the sake of simplicity is shown in generally rectangular form although, of course, the details thereof may vary. A pair of generally parallel side walls 18 extend from the tubular section for receiving, for example, a window insert as later described. Between side walls 18 edge cushions 20 are integrally extruded on the frame. Channels 22, 24 are also formed for receiving, for example, wool pyle or any other suitable sealing materials including known plastics. While the frame structure 10 is being extruded from rigid material, resilient fingers 26 are simultaneously extruded onto the frame.

In addition to the basic structure previously described various appendages are also extruded on frame 10. These appendages include a locking lip 28, a locking rail 30 and a hand lift 32. Selective appendages are removed from the basic frame in accordance with the intended use. In the preferred practive of this invention the removal operation takes place as close as practical to the extruder die head 34. To accomplish this removal operation a plurality of suitable cutting devices 36 are provided generally in line with a surface of the basic frame structure (as is apparent from FIG. 3) so that the appendages may be selectively removed preferably flush with that surface of the frame. In this manner the cutting takes place at the intersection of the appendage with the basic frame structure where the appendage is is best supported resulting in a straight cut or one that may be slightly concave. While the preferred practice of the invention involves performing the cutting operation flush (i.e. at the intersection) with the basic frame structure it is to be understood that the concepts of this invention may also be practiced where slight edges remain by performing the cutting operation spaced from the basic frame structure.

Frame 10 may be extruded from any suitable material such as a suitable plastic resin. An exemplary material for frame 10 is rigid PVC, while fingers 26 may be flexible PVC.

In practice it has been found that the extruded frame cools and rigidifies quite quickly upon exiting from the extruder. Accordingly, best results are achieved when the cutting blades 36 are located as close as possible to the die head 34. In the preferred practice of the invention the blades 36 themselves may be heated to facilitate the cutting operation depending upon the exit temperature of the frame.

As schematically illustrated in FIG. 2, after the cutting operation the appendages or excess material which is removed from the frame is then recycled for use in later extrusion operations.

Figure 4:
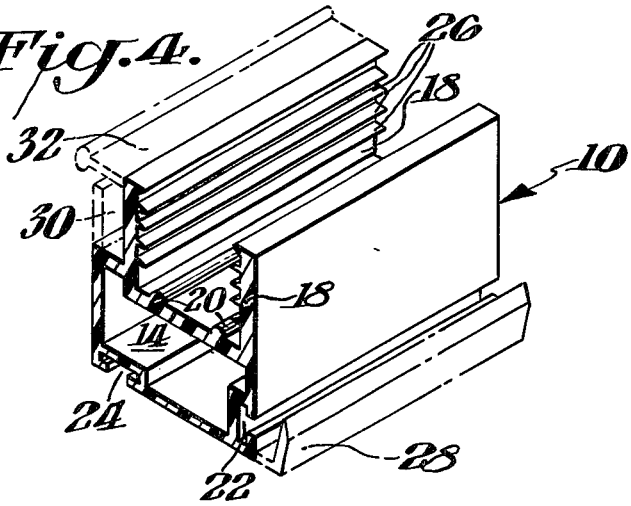
FIG. 4 is a perspective view in section of the frame structure indicated in FIG. 3 with the appendages shown in phantom.

As is apparent from FIG. 4, the same basic frame structure may thus take four different shapes in accordance with the number of appendages removed therefrom. In this respect the removal of two of the appendages results in three different structures each of which includes a single appendage, while a fourth structure results with the removal of all three appendages.

Figure 5:
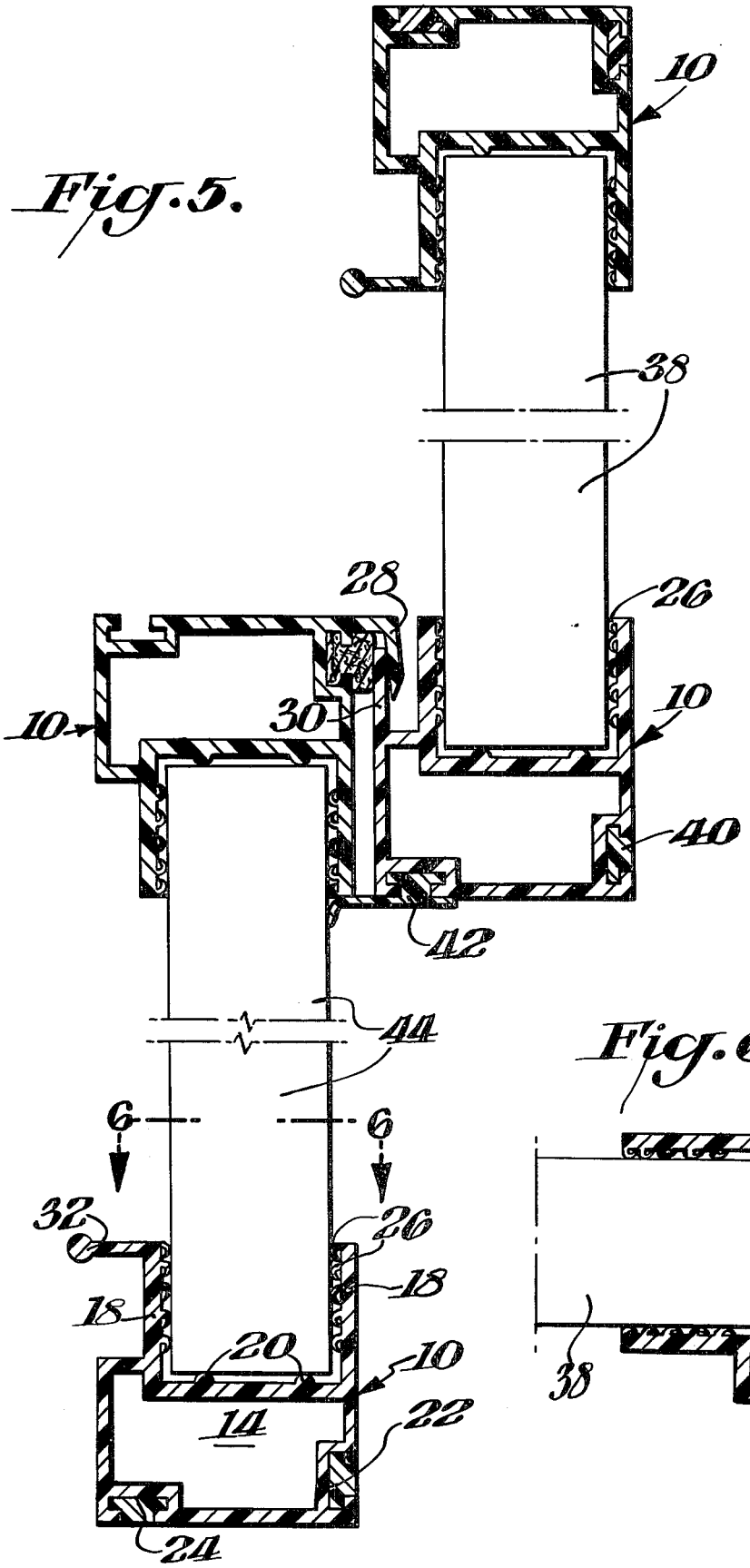
FIG. 5 is a cross-sectional view in elevation illustrating the incorporation of different forms of the inventive frame structure utilized as a unit in comprising a single window frame.
Figure 6:
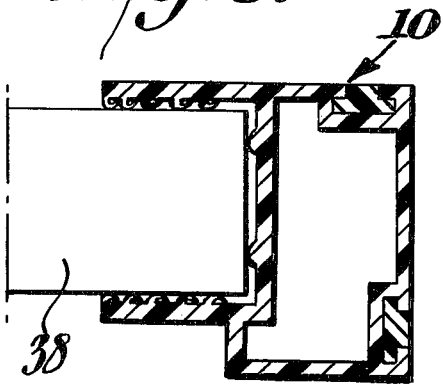
FIG. 6 is a cross-sectional view taken along the line 6—6 of FIG. 5 with the background omitted.

FIGS. 5–6 illustrate a practical use of the invention wherein all four differently structured sections are combined to form a frame for a single window having a pair of offset inserts 38, 44. As illustrated therein the top of the frame is formed by a frame section having all of the appendages removed except hand lift 32. Thus, a window insert 38, for example, is inserted between legs 18 at the top section forcing retainers 26 upwardly until the edge of the frame abuts against edge cushions 20. Suitable wool pyle retainers 40, 42 are provided in channels 22, 24, respectively. Hand lift 32 is thereby disposed for convenient manipulation to raise or lower the window. The bottom of insert 38 is framed by a frame section which includes top rail or locking rail appendage 30. In this frame section retainer fingers 26 are urged downwardly with the bottom of the insert resting upon cushions 20. The frame sides, however, of insert 38 do not include any appendages, similar to FIG. 6. Accordingly, insert 38 forming the upper sash is framed by sections including the appendage-less basic frame structure at the sides, the frame structure which incorporates the locking rail appendage at the bottom, and the frame structure which includes the hand lift appendage at the top.

FIG. 5 further illustrates the incorporation of a frame structure having locking lip appendage 28 which fits over locking rail 30 by inverting the frame structure from the position illustrated in FIG. 3. Insert 44 rests against edge cushions 20 and urges retainer fingers 26 upwardly. As shown in FIG. 6 the sides of insert 44 are framed by the basic frame structure having all appendages removed as previously described. The bottom of insert 44 is framed by a frame section which includes hand lift appendage 32 by inverting that section 180° from the section illustrated at the top of insert 38, with the frame structure otherwise functioning in the manner previously described regarding the other frame sections. Thus, the lower sash is framed at the top by a section which includes locking lip 28, is framed at the bottom by a frame structure which includes hand lift appendage 32, and is framed at the sides by sections having no appendages.

As can be appreciated the practice of the invention thereby requires only the manufacture of a single frame structure in a single extruding operation using the same extruder die. By the selective cutting of the appendages a plurality of different sections having the specific structure required for a multiple of different uses is thereby possible. It is to be understood that although the invention has been described with respect to utilization as a window frame, the concepts of the invention are not to be so limited but may have equal application for other uses. What the invention does provide is manufacturing techniques which result in the reduction of the number of different expensive die heads required, in the minimization of extruder down time, in the simplification of the extruding process since changes or interruptions are minimized, in the minimization of scrap material by avoiding die changes, and in other advantages attendant with the simplified manufacturing techniques flowing from the invention.

What is claimed is:

1. An article of manufacture for use as a section of a window frame or the like comprising a tubular body, said tubular body including a window pane receiving wall, a single pair of generally parallel legs extending away from said window pane receiving wall for receiving a window pane therebetween with the window pane supported by said window pane receiving wall, a locking rail appendage secured to said window pane receiving wall and extending away therefrom in generally the same direction as said parallel legs, a locking lip appendage secured to the wall of said tubular body remote from said window pane receiving wall at a location diametrically opposite said locking rail appendage, said locking lip appendage extending in generally the same direction as said parallel legs, said locking lip appendage being spaced from said tubular body a sufficient distance to comprise interlocking means with said locking rail appendage whereby a frame section having a locking rail appendage and another frame section having a locking lip appendage are interlocked when one of the frame sections is inverted with respect to the other frame section and the locking rail appendage thereon fits against the locking lip appendage, and said appendages thereby adapting said body to function as a different preselected frame section upon the selected removal of at least one of said appendages.

2. The article of manufacture of claim 1 wherein said frame section is extruded through a die head in an extruder, and said appendages are selectively removed generally flush with a remaining surface of said body downstream from the die head.

3. The article of manufacture of claim 1 including a hand lift appendage extending outwardly away from said parallel legs and connected thereto to provide a readily accessible handle for raising and lowering the window.

4. The article of manufacture of claim 3 wherein said body is of generally rectangular shape having vertical side walls joined by generally horizontal walls, one of said horizontal walls being said window pane receiving wall and the other of said horizontal walls being said remote wall, said locking rail appendage being a generally linear extension of one of said side walls, said locking lip appendage being generally L-shaped and being a linear extension of said remote wall, said hand lift appendage extending from and generally perpendicular to one of said legs with an edge of said hand lift appendage being a linear extension of the edge of said one leg, and said hand lift appendage being located in the general area of said locking rail appendage.

5. The article of manufacture of claim 4 wherein said body includes a pair of spaced retainer channels externally thereof, a plurality of reinforcing ribs in said body, edge cushions on said window pane receiving wall externally thereof and between said legs, and a plurality of resilient retainer fingers on each of said legs disposed toward each other.

6. The article of manufacture of claim 5 wherein said frame section is extruded in an extruder, and said appendages are selectively removed generally flush with a remaining surface of said body after said frame section exits from the extruder.

* * * * *